US005597073A

United States Patent [19]

Kocis

[11] Patent Number: 5,597,073

[45] Date of Patent: Jan. 28, 1997

[54] TRAYS FOR HOLDING FOOD PRODUCTS

[75] Inventor: Stephen J. Kocis, Roswell, Ga.

[73] Assignee: Dolco Packaging Corp.

[21] Appl. No.: 553,000

[22] Filed: Nov. 3, 1995

Related U.S. Application Data

[63] Continuation of Ser. No. 181,642, Jan. 13, 1994, abandoned.

[51] Int. Cl.[6] ..... B65D 1/34

[52] U.S. Cl. ..... 206/564; 206/521.8; 206/507; 206/521.9

[58] Field of Search ..... 206/507, 521.2, 206/521.8, 521.9, 564; 220/507, 508; D7/553, 554; D9/341, 456

[56] References Cited

U.S. PATENT DOCUMENTS

| | | | |
|---|---|---|---|
| D. 322,757 | 12/1991 | Payne | 9/425 |
| 2,885,136 | 5/1959 | Grant | 229/2.5 |
| 3,034,693 | 5/1962 | Cox | 229/2.5 |
| 3,185,370 | 5/1965 | Reifers et al. | 229/2.5 |
| 3,563,446 | 2/1971 | Pittsford et al. | 229/2.5 |
| 3,732,976 | 5/1973 | Bessett et al. | 206/564 |
| 3,846,526 | 11/1974 | Wade | 264/46.8 |
| 3,917,152 | 11/1975 | Burkett | 229/2.5 |
| 3,917,770 | 11/1975 | Jackson | 264/28 |
| 3,997,057 | 12/1976 | Craig | 206/507 |
| 4,143,111 | 3/1979 | Irwin | 264/321 |
| 4,419,068 | 12/1983 | Congleton | 425/398 |
| 5,265,756 | 11/1993 | Meier et al. | 7/42 |

FOREIGN PATENT DOCUMENTS

| | | | |
|---|---|---|---|
| 4208775 | 9/1993 | Germany | 206/564 |
| 1203349 | 8/1970 | United Kingdom | 206/564 |
| 2035267 | 6/1980 | United Kingdom | 206/564 |
| 2226808 | 7/1990 | United Kingdom | 206/521.8 |
| 9212055 | 7/1992 | WIPO | 206/564 |

*Primary Examiner*—David T. Fidei
*Attorney, Agent, or Firm*—Robbins, Berliner & Carson

[57] ABSTRACT

A tray which is formed from a piece of resilient material, has a matrix of cells for holding food products such as apples. The tray has a plurality of arched ribs formed on the piece of resilient material for reinforcing the tray, each rib joining a predetermined pair of adjacent cells and having a compound surface structure to provide enhanced strength of rigidity.

10 Claims, 3 Drawing Sheets

TRAYS FOR HOLDING FOOD PRODUCTS

This is a continuation of application Ser. No. 08/181,642, filed on Jan. 13, 1994, now abandoned.

FIELD OF THE INVENTION

The present invention relates to a tray for holding apples and other food products, to facilitate the shelving, stacking and transportation thereof.

BACKGROUND OF THE INVENTION

To reach the market, food products such as apples are typically subject to bumps and bruises from handling while undergoing grading, packaging, shipping, merchandising, etc. To protect the food products against mishandling during any one of these activities, cartons and trays, generally made of resilient material such as foamed polystyrene and pulp, are often used to hold the food products and protect them against shocks and impacts.

Not only must cartons and trays made for such purposes be soft and resilient to provide sufficient cushion, they must also be strong enough to withstand stresses applied during any of the above mentioned activities. They must also be configured to sufficiently shield the food products and be able to be stacked conveniently and securely.

SUMMARY OF THE INVENTION

The present invention provides a tray that has a matrix of cells formed on a piece of resilient material. The cells are arranged in first longitudinal rows of cells and second longitudinal rows of cells, the second rows of cells interlacing and staggering from the first rows of cells. The tray has a first set of ribs each extending between a pair of longitudinally adjacent cells for reinforcing the tray and a second set of ribs each extending between a pair of diagonally adjacent cells for further reinforcing the tray.

In another aspect, the present invention provides a tray which has a matrix of cells formed on the piece of resilient material. The tray has a plurality of ribs each extending between a pair of adjacent cells. In accordance with this aspect of the invention, each rib arches longitudinally to facilitate stacking and has a compound surface structure for reinforcing the tray.

DESCRIPTION OF THE PREFERRED EMBODIMENT

Figure 1:
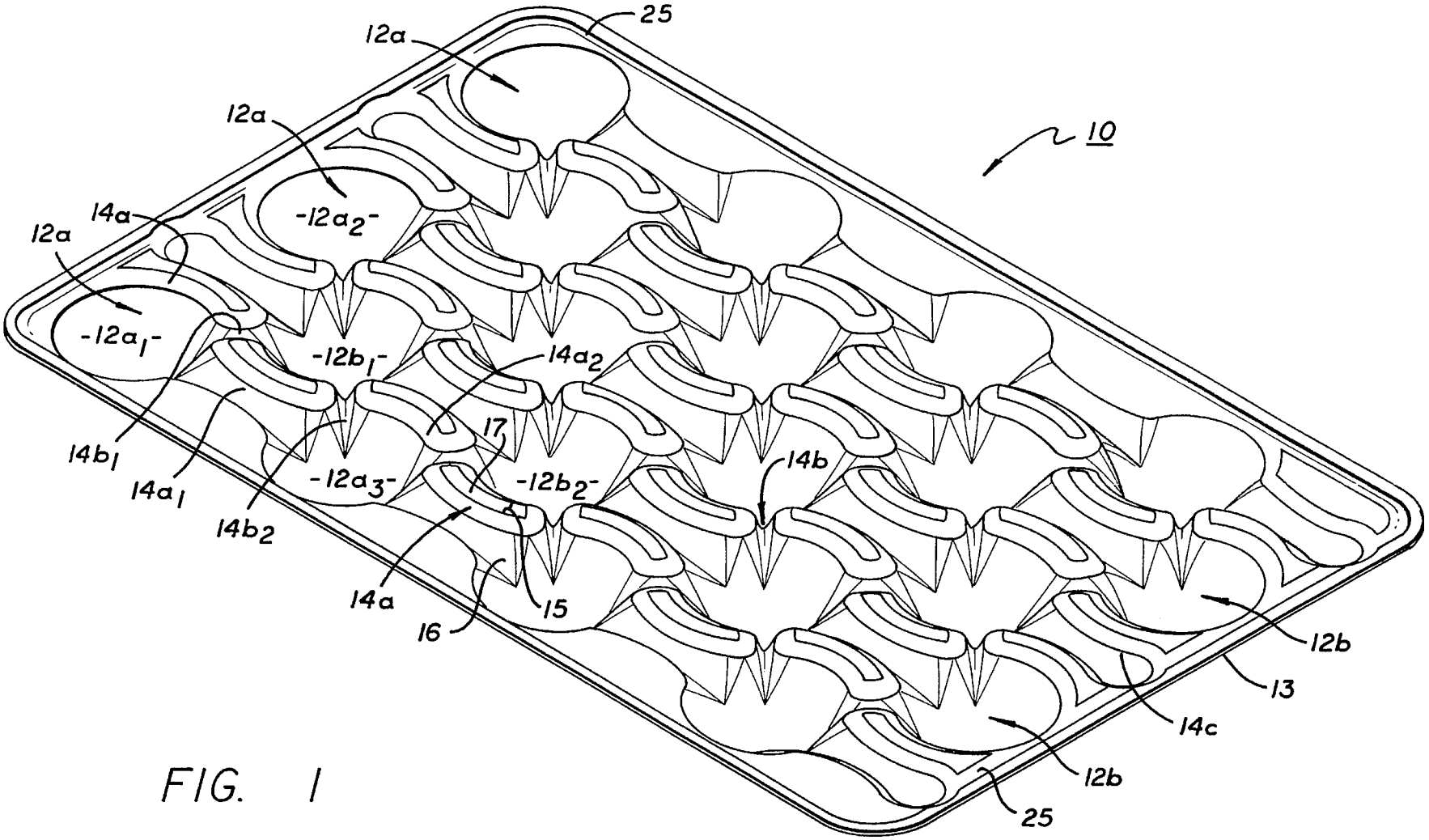
FIG. 1 illustrates an apple tray wherein the present invention is embodied.
Figure 2:
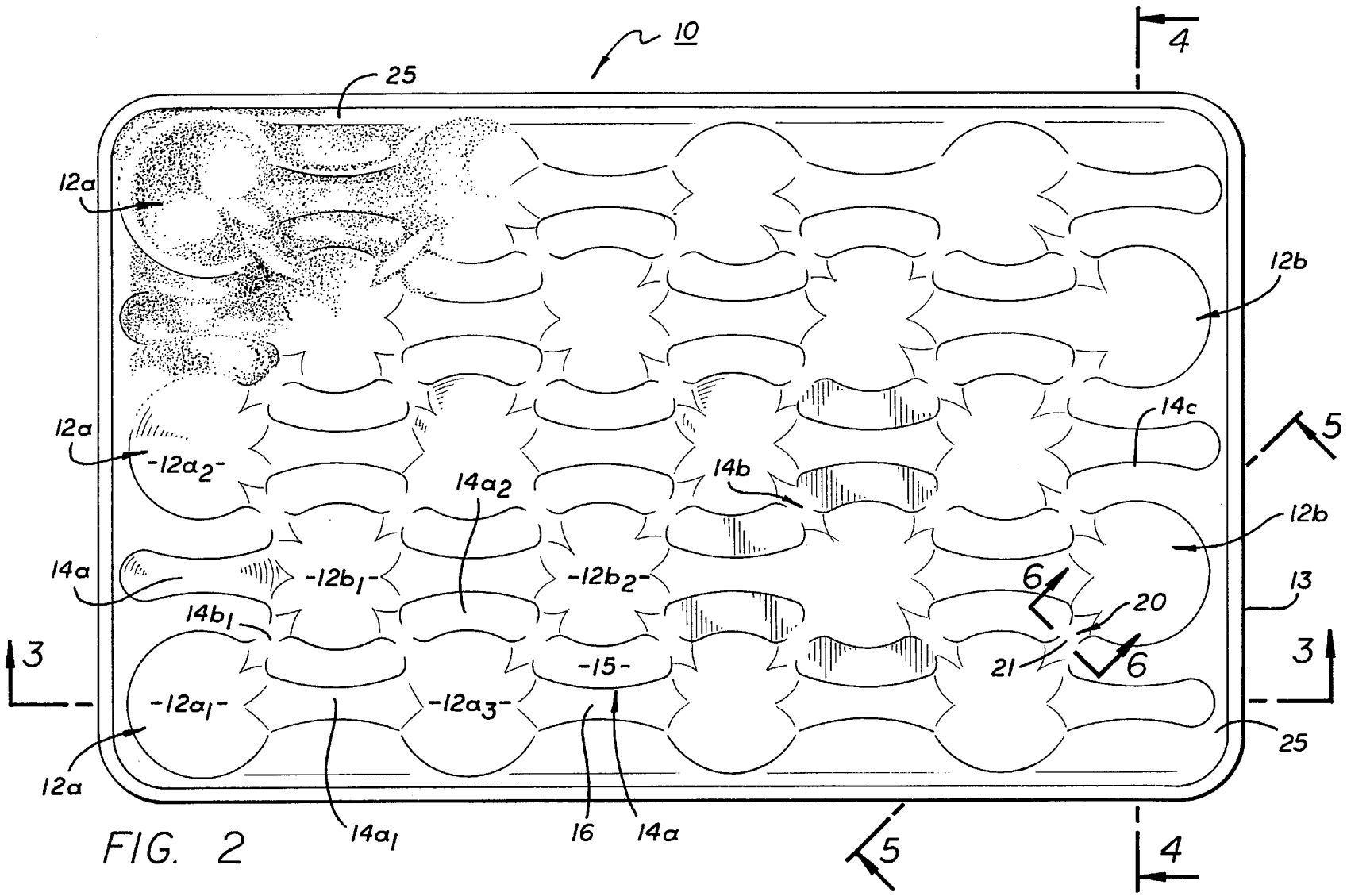
FIG. 2 is a top plane view of an apple tray shown in FIG. 1.

Referring to FIGS. 1 and 2, the tray 10 is molded from a sheeting of resilient material such as thermo-plastic polymer (e.g., foamed polystyrene), and has a matrix of cells 12*a* and 12*b*, each for holding a food product such as an apple. The matrix of cells, 12*a* and 12*b*, include first longitudinal rows of cells 12*a* and second longitudinal rows of cells 12*b*, where the first rows of cells 12*a* and the second rows of cells 12*b* interlace each other and the first and second rows of cells, 12*a* and 12*b*, also stagger from each other. For example, cell $\mathbf{12}b_1$, is located at an offset from a line joining cells $\mathbf{12}a_1$, and $\mathbf{12}a_2$ and is preferably equidistant from cells $\mathbf{12}a_1$, and $\mathbf{12}a_3$.

Figure 3:
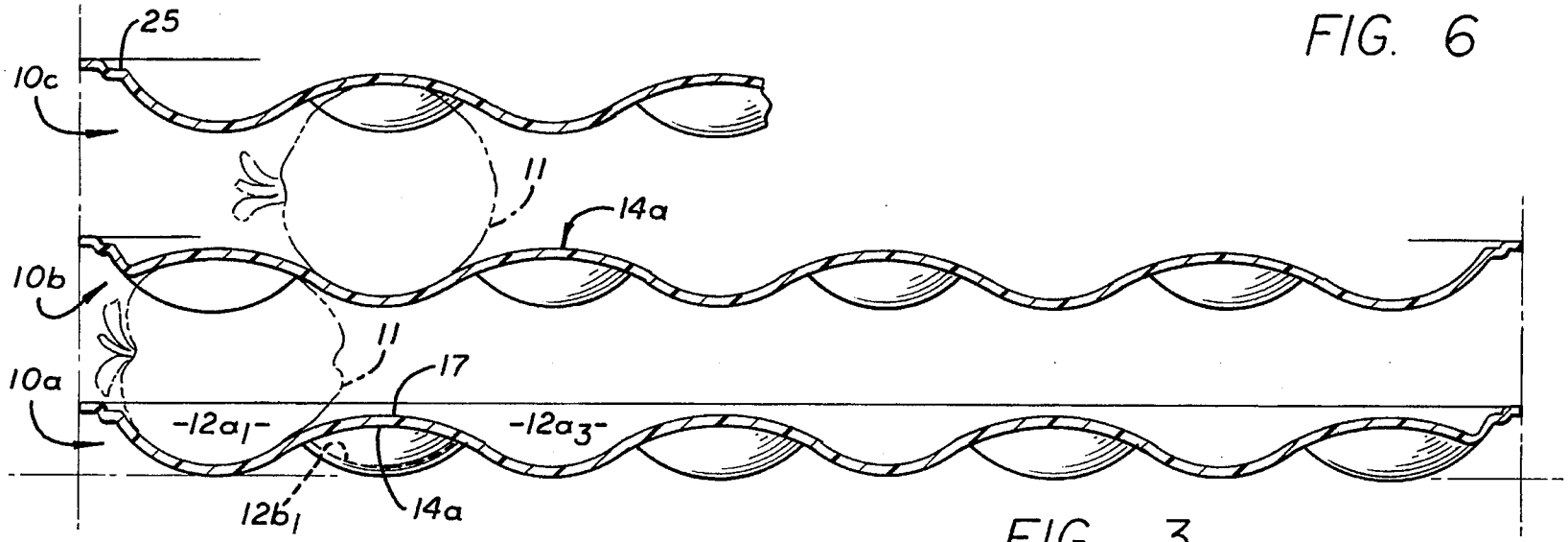
FIG. 3 is a sectional side view taken along line 3—3 passing through the centers of a row of cells shown in FIG. 2 and also showing a portion of a second tray thereon.

Referring additionally to FIG. 3, each of the cells, 12*a* and 12*b*, has a depressed area with predetermined depth and perimeter for cradling and supporting a food product 11, in this case apples, of a certain grade. A first set of ribs 14*a*, each extending between two longitudinally adjacent cells, are provided for length-wise reinforcement of the tray 10. For example, rib $\mathbf{14}a_1$ (FIG. 1) is a member of the first set of ribs 14*a* which extends between cell $\mathbf{12}a_1$ and a longitudinally adjacent cell $\mathbf{12}a_3$, both of which belong to the same row. As another example, rib $\mathbf{14}a_2$ is another member of the first set of ribs 14*a* which extends between cell $\mathbf{12}b_1$ and longitudinally adjacent cell $\mathbf{12}b_2$, both of which also belong to the same row.

A set of longitudinal ribs 14*c* are provided, each extending from an end 13 of the tray 10 to the last cell of a row if such last cell does not touch the end 13. The ribs 14C keep the ends 13 of the tray 10 supported by the food products 11 below.

Figure 4:
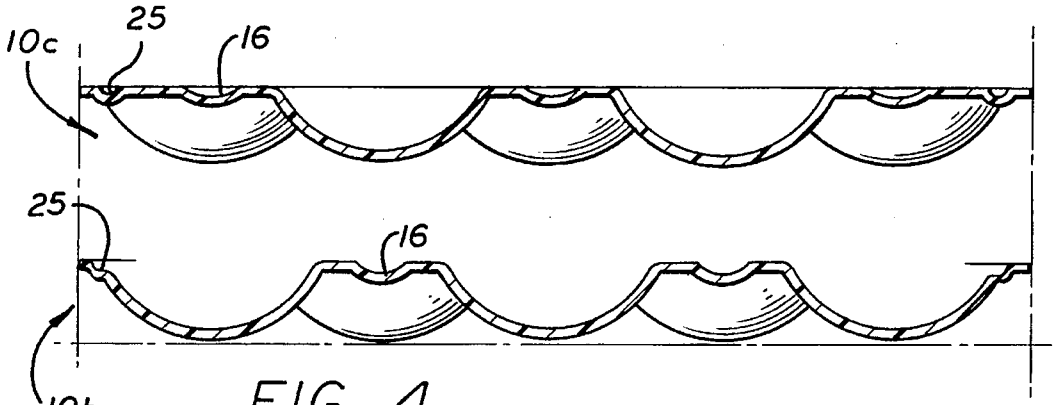
FIG. 4 is a sectional side view taken along reference line 4—4 laterally bisecting a longitudinal rib shown in FIG. 2 and also showing a portion of a second tray thereon.

Referring to FIGS. 3 and 4, each longitudinal rib 14*a* is formed by a groove 16 which extends between the two adjacent cells. Each groove 16 extends tangentially from the respective bottoms of two adjacent cells and arches upward to an apex 17 mid-way between the adjacent cells. Each rib 14*a* has a compound surface structure (i.e., the surface has a curvature in a first direction which itself is curved in another direction) for providing enhanced strength and rigidity. The sidewalls of each rib 14*a* blend smoothly into the flat top surface 15 of the tray 10 and preferably has no sharp points that would bruise the food products, yet aiding in strengthening the tray 10.

A second set of ribs 14*b*, each extending between two diagonally adjacent cells, are provided for width-wise and diagonal-wise reinforcement of the tray 10. For example, rib $\mathbf{14}b_{11}$ is a member of the second set of ribs 14*b* and extends between cell $\mathbf{12}a_1$ and diagonally adjacent cell $\mathbf{12}b_1$. For another example, rib $\mathbf{14}b_2$ is a member of the second set of ribs 14*b*. It extends between cell $\mathbf{12}b_1$ and diagonally adjacent cell $\mathbf{12}a_3$.

Figure 5:
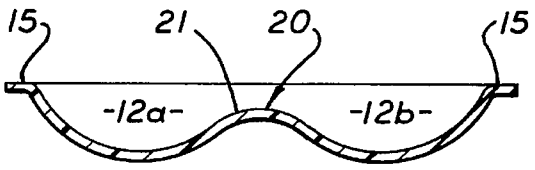
FIG. 5 is a sectional side view taken along reference line 5—5 passing through the centers of the two diagonally adjacent cells of FIG. 2.
Figure 6:
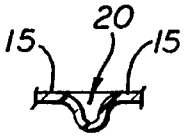
FIG. 6 is a sectional side view taken along reference line 6—6 laterally bisecting a diagonal rib of FIG. 2.

Referring to FIGS. 5 and 6, each diagonal rib 14*b* is formed by a groove 20 which extends between the pair of diagonally adjacent cells 12*a* and 12*b*. Each rib 20 extends tangentially from the respective bottoms of the cells and arches upward to an apex 21 mid-way between the two diagonally adjacent cells. The ribs 14*b* each have a compound surface structure to provide enhanced strength and rigidity. The sidewalls of each diagonal ribs 14*b* blend smoothly into the top surface 15 of the tray 10 and preferably have no sharp points that would bruise the food products, yet aiding in strengthening the tray 10.

To further increase the strength of the tray 10, a plurality of structural ribs 25 are provided along the border of the tray 10. The structural rib 25 strengthens the tray 10 by reducing fracturing that may occur at the perimeter of the tray 10, especially at the trim line of the tray 10.

The longitudinal and diagonal ribs are designed to maximize the cell surface area to better support and cradle the food products, so as to eliminate roll-out of the food products and to give more contact with the food products, thereby reducing roller burn on the skin of the food products.

The ribs 14*a* on the back side of the tray 10 also cradle food products in a lower tray that make contact with the back side of the tray 10.

FIGS. 3 and 4 show how more than one tray 10*a*, 10*b* and 10*c* can be stacked. The tray 10*b* shown in both FIGS. 3 and 4 has the same shape as tray 10*a* but is rotated 180 degrees from tray 10*a* when stacked on top of tray 10*a*. After the rotation, the arch of the longitudinal ribs 14*a* of the upper tray 10*b* can be placed on top of the food products on the lower tray 10*a*, with the food products on the lower tray providing support and stability to the upper tray 10*b*, helping to balance the weight of the food products on the upper tray 10*b* and keeping the upper tray 10*b* from cracking. Depending on the size of the food products, a number (e.g., 4 to 5) of the trays can be stacked to fill a case.

It will be understood that the scope of this invention is not limited by the design of the above described preferred embodiment. It will also be understood that the scope of this invention is not limited by the size, shape and number of the cells. Although the preferred embodiment describe an apple tray, it will be understood that the invention may also be applied to trays for holding other food products, as well as to trays made with material other than foamed polystyrene. Therefore, while the invention is described and taught using the preferred embodiment, it will be understood that various changes and modifications can be made therein without departing from the spirit and scope of the invention, which are defined by the following claims:

What is claimed is:

1. A tray, comprising:

sheeting of resilient material;

a matrix of cells formed on said sheeting, including first and second longitudinal rows of cells interlacing and staggering from each other;

a first set of ribs, each extending between a pair of longitudinally adjacent cells; and a second set of ribs, each extending between a pair of diagonally adjacent cells;

wherein each rib of the first set of ribs has a longitudinally arched surface and extends tangentially from a surface of each of the adjacent pair of cells between which said each rib of the first set of ribs extends.

2. The tray of claim 1 further including a third set of ribs forming a border of the tray.

3. The tray of claim 1 wherein said first set of ribs includes at least a subset of ribs which are colinear with a reference line passing through respective centers of a row of cells and said second set of ribs includes at least a subset of ribs colinear with a reference line passing through respective centers of a set of diagonally aligned cells.

4. The tray of claim 1 wherein each of the first and second sets of ribs has a compound surface structure.

5. The tray of claim 1 further including a third set of ribs, each extending between a cell and an edge of the tray.

6. The tray of claim 5 wherein each rib of the third set of ribs has a longitudinally arched surface.

7. The tray of claim 6 wherein each rib of the third set of ribs has a compound surface structure.

8. The tray of claim 1, wherein each rib of the first and second sets of ribs has a cross section of a groove.

9. The tray of claim 1, wherein each rib of the second set of ribs also has a longitudinally arched surface and extends tangentially from a surface of each of the adjacent pair of cells between which said each rib of the second set of ribs extends.

10. A tray, comprising:

sheeting of resilient material;

a matrix of cells formed on said sheeting; and a first plurality of arched ribs formed on said sheeting for reinforcing the tray, each rib extending between a pair of adjacent cells, and having a compound surface structure;

said arched ribs including a first set of ribs each extending between a pair of adjacent cells belong to a same one of the longitudinal rows of cells and a second set of ribs each extending between a pair of diagonally adjacent cells belonging to different ones of the longitudinal rows of cells, each rib of the first and second sets of ribs extending tangentially from a surface of each of the adjacent pair of cells between which said each rib of the first and second sets of ribs extends.

* * * * *

UNITED STATES PATENT AND TRADEMARK OFFICE

CERTIFICATE OF CORRECTION

PATENT NO. : 5,597,073

DATED : JANUARY 28, 1997

INVENTOR(S) : STEPHEN J. KOCIS

It is certified that error appears in the above-indentified patent and that said Letters Patent is hereby corrected as shown below:

Column 2, line 49, cancel "$14b_{11}$" and insert --$14b_1$--.

Signed and Sealed this

First Day of April, 1997

*Attest:*

Bruce Lehman

BRUCE LEHMAN

*Attesting Officer*

*Commissioner of Patents and Trademarks*